US010303109B2

(12) United States Patent
Hattori et al.

(10) Patent No.: US 10,303,109 B2
(45) Date of Patent: May 28, 2019

(54) IMAGE FORMING APPARATUS

(71) Applicant: KYOCERA Document Solutions Inc., Osaka (JP)

(72) Inventors: Mitsuki Hattori, Osaka (JP); Yoshihiko Kurotsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/161,974

(22) Filed: Oct. 16, 2018

(65) Prior Publication Data

US 2019/0129352 A1 May 2, 2019

(30) Foreign Application Priority Data

Nov. 2, 2017 (JP) ..... 2017-212413

(51) Int. Cl.

| | |
|---|---|
| ***G03G 21/00*** | (2006.01) |
| ***G03G 15/00*** | (2006.01) |
| ***G03G 15/20*** | (2006.01) |
| *G03G 15/16* | (2006.01) |
| *G03G 21/06* | (2006.01) |

(52) U.S. Cl.

CPC ..... *G03G 21/0035* (2013.01); *G03G 15/2064* (2013.01); *G03G 15/657* (2013.01); *G03G 15/168* (2013.01); *G03G 21/06* (2013.01)

(58) Field of Classification Search

CPC ..... G03G 21/0035; G03G 21/06; G03G 15/2064; G03G 15/657; G03G 15/168; G03G 15/2085

See application file for complete search history.

(56) References Cited

U.S. PATENT DOCUMENTS

| | | | | |
|---|---|---|---|---|
| 10,203,640 | B1 * | 2/2019 | Morita | G03G 15/2064 |
| 2016/0223970 | A1 * | 8/2016 | Hamada | G03G 15/2028 |

FOREIGN PATENT DOCUMENTS

| | | | |
|---|---|---|---|
| JP | 2008-298811 | A | 12/2008 |

* cited by examiner

*Primary Examiner* — Hoang X Ngo
(74) *Attorney, Agent, or Firm* — Stein IP, LLC

(57) ABSTRACT

An image forming apparatus includes a fixing member and a conveying guide member. The conveying guide member is arranged on the downstream side of the fixing member in the sheet conveying direction and forms a conveying passage for a sheet passed through a fixing nip portion. The conveying guide member is provided with an opening portion which is open toward the fixing member near the downstream side of the fixing nip portion in the sheet conveying direction and which allows the inside and the outside of the conveying passage to communicate with each other, and is fitted with an static eliminating member which projects from outside the conveying portion via the opening portion into the conveying passage and which touches the sheet passed through the fixing nip portion to remove electric charges.

7 Claims, 4 Drawing Sheets

IMAGE FORMING APPARATUS

INCORPORATION BY REFERENCE

This application is based upon and claims the benefit of priority from the corresponding Japanese Patent Application No. 2017-212413 filed on Nov. 2, 2017, the contents of which are hereby incorporated by reference.

BACKGROUND

The present disclosure relates to an image forming apparatus. More particularly, the present disclosure relates to an image forming apparatus provided with a static eliminating member for removing electric charges from a sheet passed through a fixing nip portion.

In conventional electrophotographic image forming apparatuses such as copiers and printers, a toner image is carried on the surface of an image carrier such as a photosensitive drum and an intermediate transfer belt, and the toner image carried on the surface of the image carrier is transferred to a sheet, and then the sheet is sent to a fixing device. Then the toner image is fixed to the sheet under application of heat and pressure by the fixing device, and the sheet is conveyed to a discharge tray or the like.

The fixing device is provided with a fixing member comprising, for example, a roller or a belt, and a toner image is fixed to a sheet by the fixing member. The sheet to which a toner image is fixed by the fixing member has electric charges, and as fixing operation is repeated, electric charges attach to and accumulate on the surface of the fixing member.

SUMMARY

According to one aspect of the present disclosure, an image forming apparatus includes a fixing member and a conveying guide member. The fixing member fixes a toner image carried on a sheet to the sheet under application of heat and pressure. The conveying guide member is arranged on the downstream side of the fixing member in the sheet conveying direction and forms a conveying passage for a sheet passed through a fixing nip portion. The conveying guide member is provided with an opening portion and is fitted with a static eliminating member. The opening portion is open toward the fixing member near the downstream side of the fixing nip portion in the sheet conveying direction and allows the inside and the outside of the conveying passage to communicate with each other to let the air inside the conveying passage pass to outside the conveying passage. The static eliminating member is fitted to the conveying guide member, projects from outside the conveying passage via the opening portion into the conveying passage, and touches the sheet passed through the fixing nip portion to remove electric charges from the sheet.

This and other objects of the present disclosure, and the specific benefits obtained according to the present disclosure, will become apparent from the description of embodiments which follows.

DETAILED DESCRIPTION

Embodiments of the present disclosure will be described below with reference to the accompanying drawings.

Figure 1:
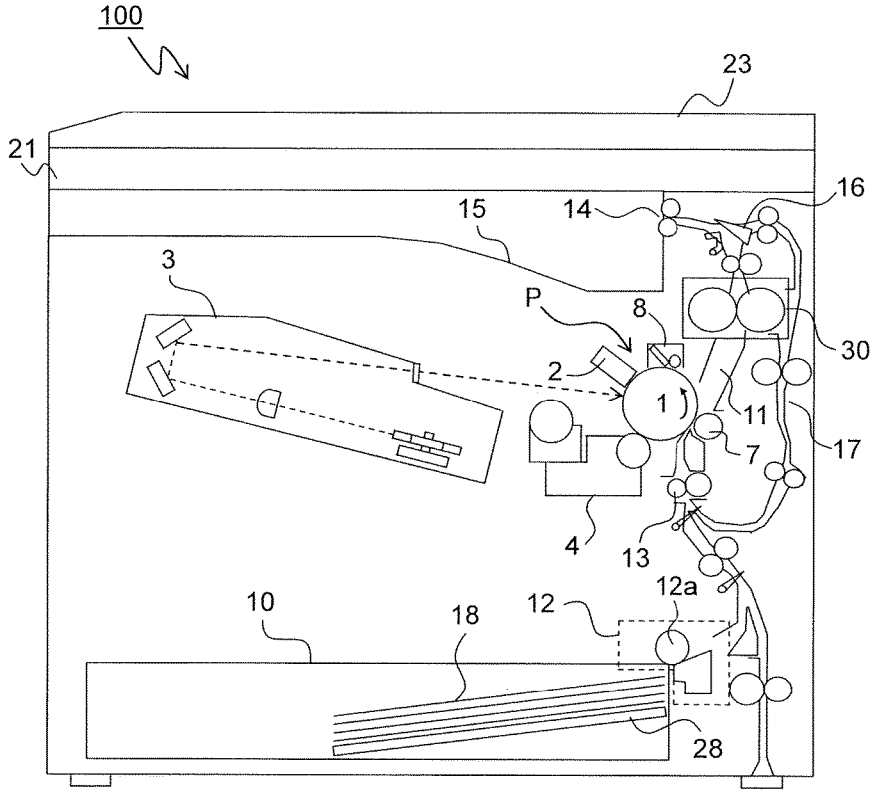
FIG. 1 is a schematic cross-sectional view showing the structure of an image forming apparatus according to one embodiment of the present disclosure.

An image forming apparatus 100 according to one embodiment of the present disclosure will be described with reference to FIGS. 1 to 3. As shown in FIG. 1, inside the main body of the image forming apparatus 100, there is arranged an image forming portion P that forms a monochrome image through processes of charging, exposure, development, and transfer. Here, a monochrome multifunction peripheral is taken as an example of the image forming apparatus 100.

In the image forming portion P, there are arranged, along the rotating direction of a photosensitive drum 1 (in the counter-clockwise direction in FIG. 1), a charging device 2, an exposure unit 3, a developing device 4, a transfer roller 7, a cleaning device 8, and a static eliminator (unillustrated). The image forming portion P, while rotating the photosensitive drum 1 in the counter-clockwise direction in FIG. 1, performs an image forming process with respect to the photosensitive drum 1.

The photosensitive drum 1 is, for example, an aluminum drum coated with a photosensitive layer, and its surface can be electrostatically charged by the charging device 2. By irradiating the surface with a laser beam from the exposure unit 3, which will be described later, the electric charge is so attenuated as to form an electrostatic latent image.

The charging device 2 electrostatically charges the surface of the photosensitive drum 1 uniformly. The exposure unit 3 irradiates the photosensitive drum 1 with a light beam (for example, a laser beam) based on document image data read in an image reading portion 21, and thereby forms an electrostatic latent image on the surface of the photosensitive drum 1.

The developing device 4 forms a toner image by attaching toner to the electrostatic latent image on the photosensitive drum 1. Here, one-component developer (hereinafter also referred to simply as toner) containing a magnetic toner component alone is contained in the developing device 4.

The transfer roller 7 transfers, without disturbing, the toner image formed on the surface of the photosensitive drum 1 to a sheet conveyed through a sheet conveying passage (conveying passage) 11. The cleaning device 8 is provided with a cleaning roller, cleaning blade, or the like that makes line contact with the photosensitive drum 1 in its longitudinal direction, and removes unused toner remaining on the surface of the photosensitive drum 1 after the transfer of the toner image to the sheet.

The image reading portion 21 includes a scanning optical system, which includes a scanner lamp that illuminates a document during copying and a mirror that changes the optical path of the reflected light from the document, a condenser lens that converges the reflected light from the document and forms an image, a CCD sensor that converts the focused image light to an electrical signal (none of these are illustrated), and reads a document image and converts it to image data. On the top face of the image reading portion 21, a platen (document presser) 23 that presses a document placed on a document stage is supported such that it can be opened and closed.

In a lower part of the image forming apparatus 100, a sheet feeding cassette 10 for storing sheets 18 is arranged. The sheet feeding cassette 10 is provided with a sheet stacking plate 28 for stacking the sheets 18 on. The sheet stacking plate 28 is configured such that its downstream side in the sheet feeding direction (the right side in FIG. 1) can ascend and descend with a swing shaft (unillustrated) on its upstream side in the sheet feeding direction acting as a pivot.

When copy operation is performed, document image data is converted to a read image signal in the image reading portion 21. On the other hand, in the image forming portion P, the photosensitive drum 1 that rotates in the counter-clockwise direction in FIG. 1 is electrostatically charged uniformly by the charging device 2, and the exposure unit 3 irradiates the photosensitive drum 1 with a laser beam (a ray of light) based on the document image data read in the image reading portion 21, and thereby an electrostatic latent image based on the image data is formed on the surface of the photosensitive drum 1. Then, the developing device 4 attaches toner to the electrostatic latent image to form a toner image.

Toward the image forming portion P, where the toner image has now been formed as described above, a sheet 18 is sent out from the sheet feeding cassette 10 by a sheet feeding device 12 that has a sheet feeding roller 12*a*, and is conveyed to the image forming portion P with predetermined timing via the sheet conveying passage 11 and a registration roller pair 13. In the image forming portion P, the toner image on the surface of the photosensitive drum 1 is transferred to the sheet 18 by the transfer roller 7. The sheet 18 having the toner image transferred to it is separated from the photosensitive drum 1, and is conveyed to a fixing device 30, where, under application of heat and pressure, the toner image is fixed to the sheet 18.

The sheet 18 passed through the fixing device 30 is directly (or after having its conveying direction switched by a branch portion 16 to a reversing conveying passage 17 and having images formed on both its faces) discharged to a discharge tray 15 by a discharge roller pair 14.

Figure 2:
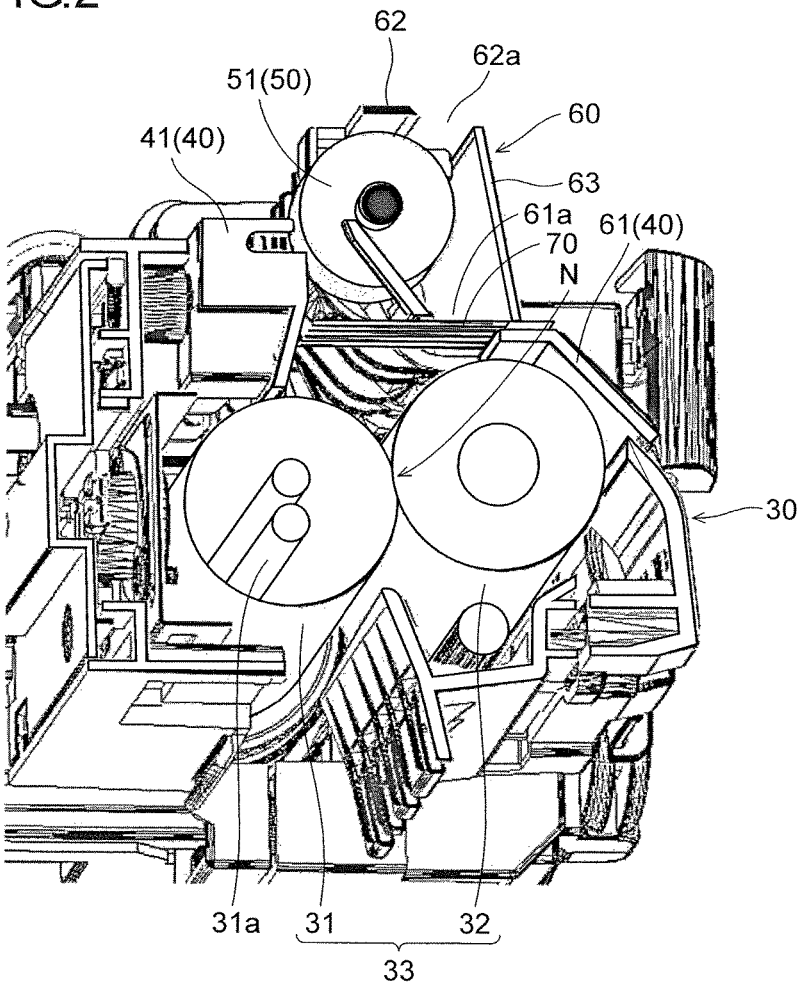
FIG. 2 is a cross-sectional perspective view showing the structure of and around a fixing roller pair in the image forming apparatus according to the one embodiment of the present disclosure.

As shown in FIG. 2, the fixing device 30 is of a heat roller fixing type, and is provided with a fixing roller pair (fixing member) 33 which includes a heating roller 31 as a heating member and a pressing roller 32 as a pressing member.

A heater 31*a* as a heat source is arranged inside the core metal of the heating roller 31. The heating roller 31 rotates in the counter-clockwise direction in FIG. 2 and the pressing roller 32 rotates in the clockwise direction in FIG. 2. The pressing roller 32 being in pressed contact with the heating roller 31 with a predetermined pressure by an unillustrated biasing member. The heating roller 31 and the pressing roller 32 form a fixing nip portion N and fix unfixed toner on the sheet 18 that passes through the fixing nip portion N.

Figure 3:
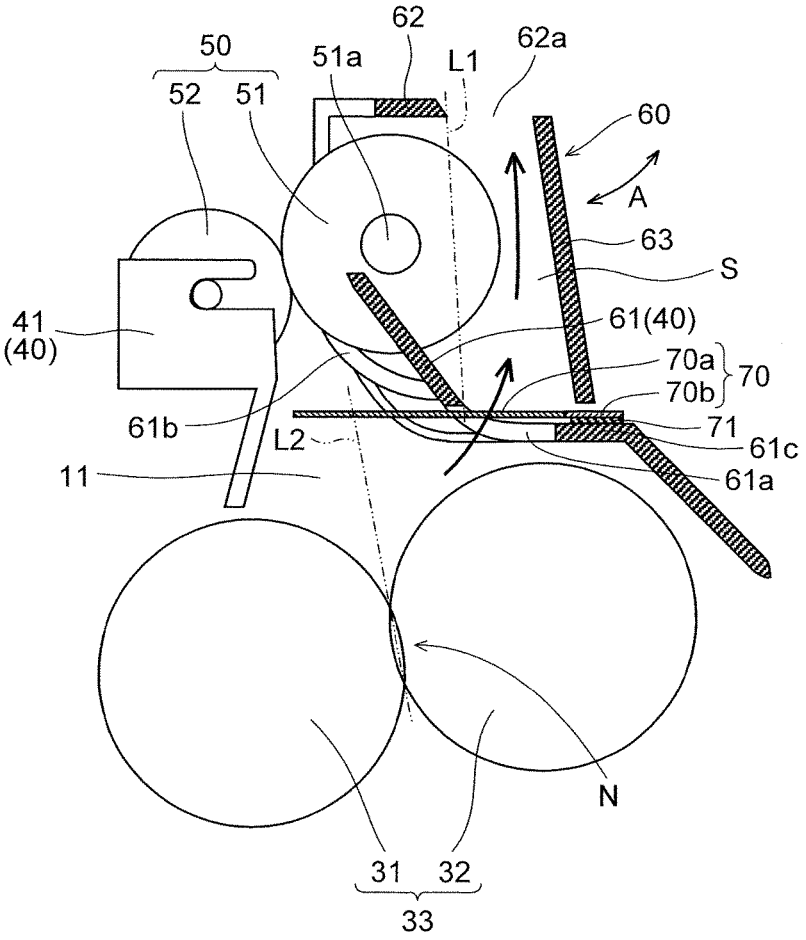
FIG. 3 is a cross-sectional view showing the structure of and around the fixing roller pair in the image forming apparatus according to the one embodiment of the present disclosure.

As shown in FIG. 3, on the downstream side in the sheet conveying direction relative to the fixing roller pair 33 (that is, on the upper part in FIG. 3), there is provided a conveying roller pair 50 that nips and conveys the sheet 18. The conveying roller pair 50 includes a first conveying roller 51 arranged on the pressing roller 32 side relative to the sheet conveying passage 11 (that is, on the right side in FIG. 3) and a second conveying roller 52 arranged on the heating roller 31 side relative to the sheet conveying passage 11 (that is, on the left side in FIG. 3).

The first conveying roller 51 is rotatably supported on a holding member 60. The holding member 60 is, as indicated by an arrow A, so configured as to be swingable about a swing shaft 64*b*, which will be described later, provided in its upper part as the center. That is, the holding member 60 holds the first conveying roller 51 such that this can move into and out of contact with the second conveying roller 52. The holding member 60 is normally (other than during maintenance) biased toward the second conveying roller 52 by a biasing member (unillustrated).

The holding member 60 is so configured as to surround the first conveying roller 51 in its circumferential direction and includes a first guide member 61 that guides a sheet 18 passing through the sheet conveying passage 11, a top face portion 62 that covers above the first conveying roller 51, and an outer face portion (side face portion) 63 that covers the first conveying roller 51 on the side opposite to the sheet conveying passage 11 (that is, on the right side in FIG. 3). The first guide member 61, the top face portion 62, and the outer face portion 63 form an internal space S for housing the first conveying roller 51.

Figure 4:
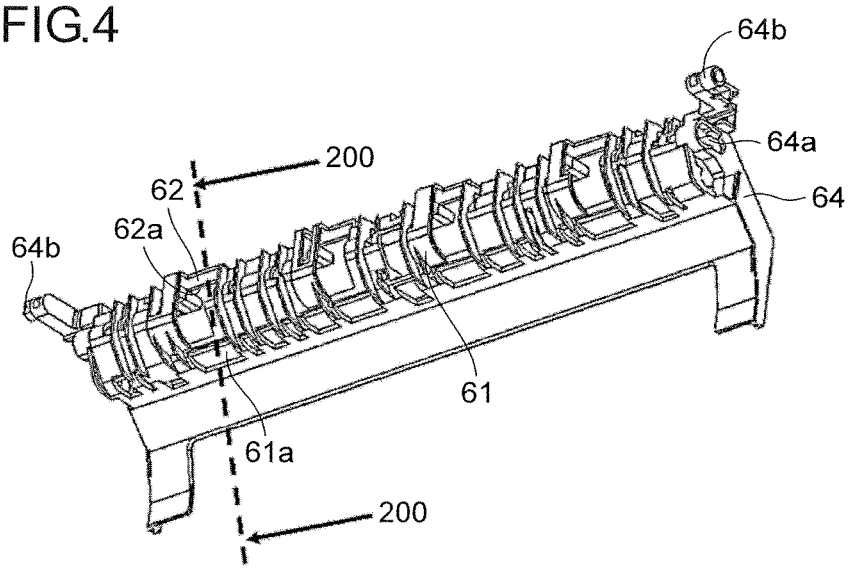
FIG. 4 is a perspective view showing the structure of a first guide member in the image forming apparatus according to the one embodiment of the present disclosure.
Figure 5:
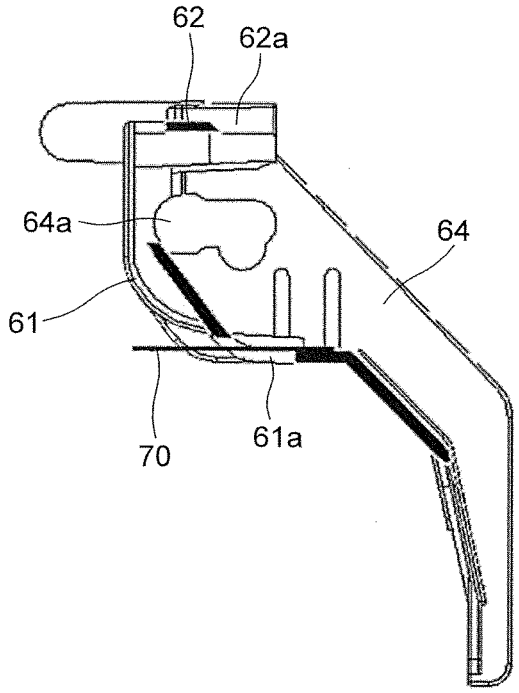
FIG. 5 is a cross-sectional view of FIG. 4 cut along line 200-200.

As shown in FIGS. 4 and 5, the first guide member 61 is formed to extend in the axial direction of the first conveying roller 51. In opposite end parts of the first guide member 61 in its longitudinal direction, there is integrally formed a supporting face portion 64 that has an insertion hole 64*a* in which a rotary shaft 51*a* of the first conveying roller 51 is inserted. In the upper end portion of the supporting face portion 64, the swing shaft 64*b* that acts as a swing center of the holding member 60 is provided.

The second conveying roller 52 is rotatably supported on a second guide member 41 that guides the sheet 18 that passes through the sheet conveying passage 11. The second guide member 41 is fixed on a housing of the fixing device 30.

The first guide member 61 and the second guide member 41 that are arranged to face each other constitute a conveying guide member 40 that forms a conveying passage for the sheet 18 passed through the fixing nip portion N.

Here, an opening portion 61*a* is formed in the first guide member 61 so as to be open toward the fixing roller pair 33 near the downstream side (the upper side) of the fixing nip portion N in the sheet conveying direction, to allow the inside and the outside of the sheet conveying passage 11 to communicate with each other, and to let the air inside the sheet conveying passage 11 pass to outside the sheet conveying passage 11 (inside the holding member 60). Specifically, the first guide member 61 includes a guide portion 61*b* that forms a side face of the sheet conveying passage 11 and guides the sheet 18, and a cover portion 61*c* that is arranged to face the pressing roller 32 and covers a part of the pressing roller 32. The opening portion 61*a* is arranged between the first conveying roller 51 and the fixing roller pair 33 so as to face the pressing roller 32 and is formed in the cover portion 61*c* so as to extend substantially in the horizontal direction (left-right direction in FIG. 3). A plurality of (here, four) opening portions 61*a* are arranged at intervals along the width direction perpendicular to the sheet conveying direction.

The opening portion 61*a* is provided with a static eliminating member 70 made of SUS (stainless steel), which touches the sheet 18 passed through the fixing nip portion N and removes electric charges from the sheet 18. The static eliminating member 70 is a static eliminating brush formed in a comb shape and includes a large number of brush portions 70*a* that extend in parallel with each other, and a main body portion 70*b* that extends in the axial direction of the pressing roller 32 and supports the large number of brush portions 70*a*. The brush portions 70*a* and the main body portion 70*b* may be formed by processing one metal plate (by etching processing or the like), or may be formed by combining separate members.

The static eliminating member 70 is attached to the face of the first guide member 61 facing away from the fixing roller pair 33 (that is, to the face not facing the fixing roller pair 33, to the top face) with double-sided tape (adhesive material) 71. The static eliminating member 70 projects into the sheet conveying passage 11 toward the second guide member 41 via the plurality of opening portions 61*a*. The tip end portion of the static eliminating member 70 is arranged between the fixing roller pair 33 and the conveying roller pair 50, on the heating roller 31 side relative to a tangent line L2 through the fixing nip portion N. The static eliminating member 70 touches the sheet 18 and removes electric charges from the sheet 18, as well as removes electric charges from the fixing roller pair 33 via the sheet 18.

On the top face portion 62 of the holding member 60, there is provided a vent hole 62*a* through which the inside (internal space S) and the outside of the holding member 60 communicate with each other and the air inside the holding member 60 (inside the internal space S) passes to outside the holding member 60 (outside the internal space S). The vent hole 62*a* is formed in a part of the top face portion 62 outward of the rotary shaft 51*a* of the first conveying roller 51 (on the side opposite to the sheet conveying passage 11, on the right side in FIG. 3). The opening portion 61*a* in the first guide member 61 is formed in a part of the first guide member 61 outward of the rotary shaft 51*a* of the first conveying roller 51 (on the side opposite to the sheet conveying passage 11, on the right side in FIG. 3). Thus, the rotary shaft 51*a* of the first conveying roller 51 is arranged on the sheet conveying passage 11 side relative to a line L1 that connects the edge of the opening portion 61*a* on the sheet conveying passage 11 side (on the left side in FIG. 3) and the edge of the vent hole 62*a* on the sheet conveying passage 11 side.

In this embodiment, as described above, the conveying guide member 40 is provided with an opening portion 61*a* that is open toward the fixing roller pair 33 near the downstream side of the fixing nip portion N in the sheet conveying direction and that releases the air inside the sheet conveying passage 11 to outside the sheet conveying passage 11. With this, steam generated from the sheet 18 when it passes through the fixing roller pair 33 can be released from inside to outside the sheet conveying passage 11 via the opening portion 61*a*. This suppresses the occurrence of dew condensation in the sheet conveying passage 11 on the downstream side of the fixing roller pair 33 in the sheet conveying direction (that is, on the surface of the conveying guide member 40 and the like), and thus attachment of dew condensation to the sheet 18 can be suppressed, and this helps suppress degradation of image quality.

The conveying guide member 40 is provided with a static eliminating member 70 that touches the sheet 18 passed through the fixing nip portion N to remove electric charges from the sheet 18. With this, the static eliminating member 70 touches the sheet 18 and removes electric charges from the sheet 18, as well as removes electric charges from the fixing roller pair 33 via the sheet 18. Thus, degradation of image quality due to an electrostatic offset can be prevented. Also, by providing the static eliminating member 70 in the opening portion 61*a* in the conveying guide member 40, steam around the static eliminating member 70 can be released to outside the sheet conveying passage 11 via the opening portion 61*a*, and this helps effectively suppress the occurrence of dew condensation on the static eliminating member 70.

Also, by providing the static eliminating member 70 in the opening portion 61*a* in the conveying guide member 40, the static eliminating member 70 can be arranged near the fixing roller pair 33, and thus the static eliminating effect of the static eliminating member 70 on the fixing roller pair 33 can be improved.

As described above, the opening portion 61*a* is provided on the cover portion 61*c* of the first guide member 61, and the static eliminating member 70 projects into the sheet conveying passage 11 through the opening portion 61*a* toward the second guide member 41. With this, the static eliminating member 70 touches the reverse side of the sheet 18 (the side opposite to the printed side). The reverse side of the sheet 18 is more prone to be electrostatically charged than the printed side. By providing the opening portion 61*a* in the first guide member 61, the static eliminating member 70 can efficiently remove electric charges from the sheet 18. This also prevents the printed side of the sheet 18 from being scratched by the static eliminating member 70.

As described above, the tip end portion of the static eliminating member 70 is arranged on the heating roller 31 side relative to the tangent line L2 including the fixing nip portion N. This ensures that the sheet 18 passed through the fixing nip portion N touches the static eliminating member 70 and thus it is possible to remove electric charges reliably from the sheet 18.

As described above, the plurality of opening portions 61*a* are arranged at intervals along the width direction perpendicular to the sheet conveying direction, and the static eliminating member 70 projects into the sheet conveying passage 11 through the plurality of opening portions 61*a*. This effectively suppresses the occurrence of dew condensation in the sheet conveying passage 11 on the downstream side of the fixing roller pair 33 in the sheet conveying direction, as well as effectively removes electric charges from the sheet 18.

As described above, the static eliminating member 70 is attached to the face of the conveying guide member 40 facing away from the fixing roller pair 33 (that is, to the face not facing the fixing roller pair 33) with double-sided tape 71. This prevents hot steam generated from the sheet 18 when it passes through the fixing roller pair 33 from directly touching the double-sided tape 71, suppressing deterioration of the double-sided tape 71. Thus, it is possible to prevent the double-sided tape 71 from peeling off from the conveying guide member 40. Also, when the holding member 60 is swung upward for exposing the fixing nip portion N for jam handling, exposure of double-sided tape 71 can be suppressed, and thus it is possible to prevent the double-sided tape 71 from peeling off from the conveying guide member 40 by being touched by user's hands or fingers.

As described above, the top face portion 62 is provided with the vent hole 62*a* for releasing the air in the internal space S to outside the internal space S. With this, steam having flowed into the internal space S via the opening portion 61*a* can be released via the vent hole 62*a* to outside the internal space S, and thus steam in the sheet conveying passage 11 can be efficiently released to outside the sheet conveying passage 11 and the holding member 60. This can also suppress the occurrence of dew condensation on the first conveying roller 51.

As described above, the rotary shaft 51*a* of the first conveying roller 51 is arranged on the sheet conveying passage 11 side relative to the line L1 that connects the edge of the opening portion 61*a* on the sheet conveying passage 11 side and the edge of the vent hole 62*a* on the sheet conveying passage 11 side. With this, it is possible to prevent steam flowing from the opening portion 61*a* to the vent hole 62*a* from touching the rotary shaft 51*a* of the first conveying roller 51, and thus the occurrence of dew condensation on the rotary shaft 51*a* of the first conveying roller 51 can be suppressed.

As described above, the static eliminating member 70 is a static eliminating brush. Thus steam passes between the brush portions 70*a* of the static eliminating member 70, and this prevents steam from stagnating around the static eliminating member 70. With this, the occurrence of dew condensation on the static eliminating member 70 can be further suppressed. Forming the static eliminating member 70 with SUS (stainless steel) improves the strength of the static eliminating member 70, as well as prevents drops of water from attaching to the static eliminating member 70, and thus it is possible to prevent the static eliminating member 70 from breaking.

The embodiment disclosed above should be understood to be in every aspect illustrative and not restrictive. The scope of the present disclosure is defined not by the description of the embodiment given above but by the appended claims, and should be understood to encompass any modifications made in the sense and scope equivalent to those of the claims.

For example, while the above embodiments deal with an example where the present disclosure is applied to a multi-function peripheral, this is not meant to limit the present disclosure. Needless to say, the present disclosure can be applied to various image forming apparatuses provided with a fixing device, such as printers, copiers, and facsimile machines.

While the above embodiments deal with an example where the opening portion 61*a* is provided in the first guide member 61 arranged on the pressing roller 32 side of the sheet conveying passage 11, this is in no way meant to limit the present disclosure. Instead, the opening portion 61*a* may be provided in the second guide member 41 arranged on the heating roller 31 side of the sheet conveying passage 11.

While the above embodiments deal with an example where the heating roller 31 and the pressing roller 32 are arranged substantially in the horizontal direction and convey the sheet 18 upward. Instead, the heating roller 31 and the pressing roller 32 may be arranged in the up-down direction and convey the sheet 18 substantially in the horizontal direction. In this case, the opening portion may be provided in the conveying guide member which is arranged on the downstream side of the fixing roller pair 33 in the sheet conveying direction and above the sheet conveying passage.

While the above embodiments deal with an example where the static eliminating member 70 is fixed to the face (top face) of the first guide member 61 facing away from the fixing roller pair 33. Instead, the static eliminating member 70 may be fixed to the face (bottom face) of the first guide member 61 facing the fixing roller pair 33.

Any configurations achieved by combining the configurations of the embodiments and modified examples described above are also within the technical scope of the present disclosure.

What is claimed is:

1. An image forming apparatus comprising:

a fixing member which fixes a toner image carried on a sheet to the sheet under application of heat and pressure; and a conveying guide member which is arranged on a downstream side of the fixing member in a sheet conveying direction and which forms a conveying passage for the sheet passed through a fixing nip portion, wherein the conveying guide member is provided with an opening portion which is open toward the fixing member near a downstream side of the fixing nip portion in the sheet conveying direction and which allows an inside and an outside of the conveying passage to communicate with each other to let air inside the conveying passage pass to outside the conveying passage, and a static eliminating member is fitted to the conveying guide member and projects from outside the conveying passage via the opening portion into the conveying passage, the static eliminating member touching the sheet passed through the fixing nip portion to remove electric charges from the sheet.

2. The image forming apparatus according to claim 1, wherein the fixing member includes a heating member and a pressing member being in pressed contact with the heating member to form the fixing nip portion, the conveying guide member includes a first guide member arranged on a pressing member side and a second guide member arranged on a heating member side, the first and second guide members being arranged so as to face each other and form the conveying passage, the first guide member includes a guide portion which forms a side face of the conveying passage and guides the sheet, and a cover member which is arranged so as to face the pressing member and covers a part of the pressing member, the opening portion is provided on the cover portion of the first guide member, and the static eliminating member projects into the conveying passage through the opening portion toward the second guide member and touches the sheet passed through the fixing nip portion.

3. The image forming apparatus according to claim 2, further comprising:

a conveying roller pair which is composed of a first conveying roller and a second conveying roller and which is arranged in the downstream side of the fixing member to convey the sheet, wherein the fixing member is a fixing roller pair composed of a heating roller as the heating member and a pressing roller as the pressing member, the first guide member is provided with the first conveying roller, the opening portion is arranged between the first conveying roller and the pressing roller so as to face the pressing roller in the sheet conveying direction, and a tip end portion of the static eliminating member is arranged on the heating roller side relative to a tangent line including the fixing nip portion.

4. The image forming apparatus according to claim 3, wherein the second guide member is provided with the second conveying roller, and the tip end portion of the static eliminating member is arranged between the heating roller and the second conveying roller in the sheet conveying direction.

5. The image forming apparatus according to claim 2, further comprising:

a conveying roller pair which is composed of a first conveying roller and a second conveying roller and which is arranged in the downstream side of the fixing member to convey the sheet, wherein the first guide member is rotatably provided with the first conveying roller and is provided with a top face portion and a side face portion, the top face portion and the side face portion together with the first guide member, form an internal space for housing the first conveying roller, and the top face portion is provided with a vent hole for releasing air in the internal space to outside.

6. The image forming apparatus according to claim 1, wherein the opening portion includes a plurality of the opening portions, the plurality of the opening portions are arranged in the conveying guide member at intervals along a width direction perpendicular to the sheet conveying direction, and the static eliminating member projects into the sheet conveying passage through the plurality of opening portions.

7. The image forming apparatus according to claim 1, wherein the static eliminating member is a static eliminating brush made of stainless steel.

* * * * *